US006421883B1

(12) United States Patent
Stäheli et al.

(10) Patent No.: US 6,421,883 B1
(45) Date of Patent: Jul. 23, 2002

(54) SELECTIVE CLEANING LINE

(75) Inventors: Christoph Stäheli, Frauenfeld; Jürg Faas, Andelfingen, both of (CH); Ulf Schneider, Hof (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/721,423

(22) Filed: Nov. 22, 2000

(30) Foreign Application Priority Data

Nov. 24, 1999 (SE) ..... 1999 2152/99
Feb. 16, 2000 (DE) ..... 100 06 853

(51) Int. Cl.[7] ..... D01B 3/04
(52) U.S. Cl. ..... 19/65 A; 19/200; 19/205
(58) Field of Search ..... 19/65 A, 200, 19/204, 205, 105; 209/555, 570

(56) References Cited

U.S. PATENT DOCUMENTS

| | | | | |
|---|---|---|---|---|
| 4,171,262 A | * | 10/1979 | Lattmann et al. | 209/555 |
| 4,535,511 A | | 8/1985 | Leifeld et al. | |
| 4,866,815 A | * | 9/1989 | Lucassen et al. | 19/205 |
| 4,876,769 A | | 10/1989 | Schlepfer et al. | |
| 4,940,367 A | | 7/1990 | Staheli et al. | |
| 4,977,645 A | * | 12/1990 | Hosel | 19/200 |
| 5,181,295 A | | 1/1993 | Demuth et al. | |
| 5,205,019 A | * | 4/1993 | Schnlichter et al. | 19/200 |
| 5,224,243 A | | 7/1993 | Schlepfer et al. | |
| 5,287,599 A | * | 2/1994 | Leifeld | 19/205 |
| 5,361,458 A | | 11/1994 | Demuth et al. | |
| 5,410,401 A | | 4/1995 | Shofner et al. | |
| 5,819,373 A | * | 10/1998 | Schlichter et al. | 19/205 |
| 5,933,921 A | | 8/1999 | Jossi | |

FOREIGN PATENT DOCUMENTS

| | | |
|---|---|---|
| DE | 344942 | 12/1921 |
| DE | 19820914 | 11/1989 |
| DE | 0399315 B1 | 11/1990 |
| DE | 4340173 A1 | 6/1995 |
| DE | 19722537 | 2/1998 |
| EP | 0396546 B1 | 11/1990 |
| EP | 0475073 A1 | 3/1992 |
| EP | 0497535 A1 | 8/1992 |
| EP | 0548023 A1 | 6/1993 |
| EP | 0604878 A1 | 7/1994 |
| EP | 0641876 A1 | 3/1995 |
| EP | 0810309 A1 | 12/1997 |
| EP | 0824607 B1 | 2/1998 |
| EP | 0893516 A1 | 1/1999 |
| GB | 2210907 | 6/1989 |
| JP | 59116424 | 7/1984 |
| JP | 61167029 | 7/1986 |

OTHER PUBLICATIONS

EPO Search Report, May 26, 2000.

* cited by examiner

*Primary Examiner*—John J. Calvert
*Assistant Examiner*—Gary L. Welch
(74) *Attorney, Agent, or Firm*—Dority & Manning

(57) ABSTRACT

A flock transportation device with a switching device for the flock stream includes a monitoring apparatus which detects the degree of contamination of the fiber material. The monitoring apparatus includes an evaluation device which determines the cleaning requirements of the detected material and which controls the switching device accordingly. A flock processing installation is contemplated with several transportation paths which comprise different treatment characteristics. Additionally, the flock processing installation can be controlled by way of a central control systems.

15 Claims, 5 Drawing Sheets

Prior Art

SELECTIVE CLEANING LINE

BACKGROUND

The invention is concerned with the layout of the blowing room of a spinning mill. In this description the term "blowing room" also includes the card room, which takes over fibre materials from the traditional cleaning devices of the blowing room for further processing.

It is not feasible economically to adapt the blowing room in advance for a predetermined fibre material. Blowing rooms therefore are designed to process different kinds of material (varieties) whereat the end user can change from one variety to another or can even process different varieties practically at the same time ("multi-variety-operation").

Controllable blowing room lines are disclosed in the following publications:

DE-A-3,244,619—Trützschler

DE-A-3,44,942—Trützschler

EP-A497,535—Crosrol

EP-A-303,023—Rieter

EP-A-311,831—Rieter

EP-A-548,023—Rieter

Blowing room lines still comprise a number of machines which receive the fibre material one after each other. It is known that there exist complex reciprocal effects between the different operating parameters (for instance such as the through put flow volume of fibre materials and aggressiveness of the fibre treatment) and the achievable characteristics of the supplied fibre material (normally in the form of flocks from the cleaning machines or sliver respectively—or at the most a fibre web—from the card). These complex reciprocal effects led to proposals which aim to simplify the setting of the single machine. This is for instance described in EP-A-399,315 or EP-A-641,876, GB-A-2210970 and EP-A452,676. The application GB-A-2210907 for instance, describes a device which serves the optimization of the cleaning or operating parameters respectively of the succeeding fibre processing machine. The degree of contamination of the fibre flocks is continuously monitored and based on the measured values the operating parameters of the succeeding fibre processing machine are adjusted automatically. Improvements of the possibilities to adjust the machines, or of the line respectively as a whole, allow an optimization of the prevailing circumstances, however, they cannot overcome a certain phenomenon: the higher the throughput flow volume, the more difficult it is to achieve the desired characteristics of the supplied product.

It has recently been suggested to transfer the so called "fine cleaning" from the traditional blowing room to the card room, whereat the filling chutes of the individual cards are to be laid out as cleaning machines—see for instance EP-A-810,309. This allows to reduce the throughput flow during the fine cleaning stage without having to reduce the effective production of the whole line.

It is also known for instance from U.S. Pat. No. 4,171,262 to monitor the fibre material during processing in the blowing room, for instance in the form of a flock stream and to activate a switching means in dependence of the detected results. In the case of an arrangement according to U.S. Pat. No. 4,171,262, a transportation path is to lead from the switching means into a waste container. The flock flow is diverted to the waste container if metal parts are detected by the monitoring apparatus. Thus the machines that follow in the line are to be protected against foreign matter. In DE-A-197 22 537 there is also a device described which succeeds the bale opener and which serves the extraction of foreign particles. The separation is accomplished with the application of an image processing device. Said device measures the brightness level and/or the colour of the transported material and compares it with set values. Material which does not comply with the set value is discharged. In the meantime, such monitoring apparatuses have been further developed in particular regarding their sensory capabilities. Examples of new devices which operate with optical sensors are disclosed in EP-A-396,546; EP-A-824,607 and DEA-4340173. One has also to expect further developments of the (optical) sensors.

SUMMARY

It is an object of the present invention to suggest new blowing room arrangements which allow a better adaptation of the treatment of the fibres to the effective requirements. Additional objects and advantages of the invention will be set forth in part in the following description, or may be obvious from the description, or may be learned through practice of the invention.

Accordingly, an embodiment of the invention provides a flock transportation device with a switching means for the flock stream, with a monitoring apparatus which detects the degree of contamination whereat the monitoring apparatus carries out an evaluation which determines the cleaning requirements of the detected materials and which controls the switching means accordingly.

The invention further comprises a fibre processing method which requires several transportation paths with different characteristics. Via a common supply means the fibres are allocated to the transportation paths, whereat within the common supply means the condition of the fibres is detected. Afterwards, the fibres are let to one or to the other transportation paths depending on the measured results.

The invention also comprises a fibre processing installation with several transportation paths, which are equipped for different treatment characteristics, and with a common fibre supply means for the mentioned transportation paths. A monitoring apparatus is provided in order to detect the condition of the fibre being supplied through the supply means. The installation also includes a controllable switching means in order to switch the flock stream to the different transportation paths depending on the measured results.

A "transportation path" is to be understood as the route through which a single fibre flock travels from the bale opener up to the end product (for instance in the sliver after the card). Everywhere a material supply leads through a switching means or through a switching apparatus into two or three branches, then as many new transportation paths are established. A transportation path is actually characterized by its sub-sections. Each sub-section comprises one or several treatment stages (a treatment stage according to the technology is being defined and can consist of one or several machines, for instance the fine cleaning). Depending on how the switching means or the switching apparatus respectively are set, the flocks flow through different sub-sections and thus through a transportation path with one treatment characteristic which is characterized by its sub-section. A sub-section can of course belong to several transportation paths. In a first embodiment the end products of the single transportation paths are processed separately. According to a second embodiment of the invention, however, it is intended that the end products of individual transportation paths, which actually possess different characteristics, are being mixed again partly or as a whole (for instance the end product of a transportation paths with a low quality is being mixed with several end products of high quality). With an only partial mix this way, one thus obtains practically several end products (or "product lines") with different fibre characteristics at the same time. This is kind of multi-variety operation. A second kind of such a multi-variety operation can be realized with a central control means and is described in the following paragraph.

A further type of embodiment of the invention, besides the different transportation paths with different treatment characteristics, a central control means. Said control means can, in addition to the monitoring apparatuses, control the single switching means and the switching apparatuses. It is also possible that the control means processes and/or registers the evaluations of the monitoring apparatus centrally. The preferred features of such a fibre processing installation includes the possibility that the transportation paths can partly be predetermined. Thus several "product lines" with different compositions (qualities respectively) in the end products can be formed. It is for instance possible that there is a given bale with several varieties (that is fibre bales of different origin and quality with different fibre characteristics such as staple length, degree of contamination etc.). The bale opener, for instance the A11 of Rieter, takes off the flocks one by one from the various bales. An installation which takes off flocks from bales of different origins and which at the same time adapts the operating parameters of the succeeding treatment steps to the variety of the actual bale being opened is already known with the EP-A-399,315. Furthermore it is known from this application that one end product with one composition can be obtained. With the installation according to the invention it is however possible, thanks to a central control unit, to have a bale supply with several varieties and to control the fibre material flow of the individual bales through the transportation paths up to the end product (multi-variety operation). This way there are several end products of different, homogeneous compositions are being produced. Simultaneously, the transported flocks are also treated according to the evaluated cleaning requirement. The composition of the different varieties in the end products of the individual "product lines" can be predetermined by the central control unit (however, end products with fibres of only one single variety are also possible).

Of course it is also possible to program the central control unit in such a way that it—as far as possible—also optimizes the transportation path according to the momentarily delivered fibre quantity. This is especially of advantage, if certain transportation lines can only treat a limited throughput quantity of fibres. Where necessary, the single sub-sections may also comprise intermediate storages in order to balance natural inconsistencies in the fibre supply. Preferably, the intermediate storages can at the same time also be used as feeding chutes for the succeeding treatment stage.

The invention includes therefore the following devices, methods and applications:

A flock transportation device for textile processing machines with a switching means for the flock stream, which contains one or several monitoring apparatuses which measure the degree of contamination of the transported fibre material, whereat the monitoring apparatus or a further apparatus (for instance the succeeding switching means, a control means) each carries out an evaluation which determines the cleaning needs of the detected material and which at least controls one switching means accordingly.

The invention also comprises a flock transportation device with one or several so called by-pass units which can be connected in a series as well as in a parallel arrangement. One by-pass unit possesses a common flock supply means which separates into two or several transportation paths, whereat the first transportation path is without any treatment stage and all the other transportation paths are provided with a treatment stage. At the end of the by-pass unit the transportation paths merge again so that the transportation paths of the by-pass unit again have a common outlet, that is each by-pass unit has only one outlet.

The by-pass unit can be designed in such a way in that each unit on the common flock supply means is provided with a monitoring apparatus and a switching element succeeding said monitoring apparatus, whereby the monitoring apparatus carries out an evaluation which determines the cleaning requirements of the transported fibre material and which controls the succeeding switching means accordingly and, which either guides the evaluated fibre material onto a transportation path with a suitable treatment stage or onto a transportation path without any treatment stage. At the end of the by-pass unit, the transportation paths merge again per definition, so that one single outlet of the by-pass unit results.

Additionally, to the mentioned flock transportation devices, a flock processing method for textile processing machines is also comprised in the invention. The method is characterized in that several transportation paths with different treatment characteristics are provided, so that the flocks are fed over a common flock supply means through one transportation path, whereat within the common flock supply means the condition of the flocks is being monitored and that, depending on the measured results of these tests, the flocks are forwarded into one or another transportation paths. One of the transportation paths can also be without a treatment stage (by-pass system).

The flock processing method mentioned in the last paragraph also comprises the by-pass units according to the invention. That means that several transportation paths with different treatment characteristics are provided. The flocks are supplied over a common flock supply means through one transportation path, whereat in the common flock supply means the condition of the flocks is monitored, and that depending on the measured results the flocks are being guided to one or the other transportation paths and that the transportation paths merge again at their end.

To the flock processing installation for textile processing machines with several transportation paths with different treatment characteristics, with a common flock supply means (for instance from the bale opener) for the mentioned transportation path, the invention also includes one or several monitoring apparatuses. Said monitoring apparatuses measure and detect the condition of the momentarily transported flocks. Thereby one or several controllable switching means are provided which guide the flock stream, depending on the measured results (that is the condition of the fibre flocks) to the suitable transportation path.

For some types of embodiments of the invention, it is not important whether the evaluation of the measured results (condition of the fibre flocks) is carried out in the monitoring apparatus or in the switching means. The invention provides for both possibilities. Normally the monitoring apparatus will carry out the evaluation and when reaching a certain threshold value (certain degree of contamination of the fibre flocks), it gives the signal for switching to the switching means. This is a particular advantage, in that in addition also a central control unit can be provided. Said central control unit could register the measured values and carry out further evaluations, for instance determining the optimal operating parameters of the following treatment stage in the concrete transportation path-sub-section and it could transmit these parameters to the corresponding machines or control them respectively. The invention however, is not limited to this possibility. It is for instance also possible that the monitoring apparatus only carries out the detection or the measurement respectively and continuously sends a signal to the switching means. Only when this signal reaches a certain threshold value—being preset within the switching means—then does said switching means switch. It is also possible that the monitoring apparatus carries out the evaluations or it only carries out the measuring continuously and transmits these to the central control means, which then decides or first evaluates the measuring values respectively, and then decides whether the switching means needs to be activated or not (possibly in dependence of other factors).

As already mentioned above, a flock processing installation for textile processing machines can also comprise transportation paths with one or more by-pass unit. With several by-pass units said units can be arranged behind each other, i.e. in series and/or next to each other i.e. parallel.

The invention may include that the transportation paths pertaining to the flock processing installation each can comprise one or several treatment stages. The transportation paths consist, as already mentioned, of not less than one sub-section. Each sub-section may include one or several treatment stages.

The results determined by the monitoring apparatus about the condition of the flocks can also serve for setting the operating parameters of the succeeding treatment stage or treatment stages. Amongst other facts, the measurements of the monitoring apparatuses can be evaluated by the monitoring apparatuses themselves, by the central control means, or by a further evaluation apparatus being connected to the succeeding treatment stages.

The invention includes the application of the required monitoring apparatuses in the flock transportation devices and flock processing installations. Said means may measure the degree of nep presence of the fibre flocks and/or the degree of contamination of the fibre flocks and/or the degree of opening of the fibre flocks. The monitoring apparatuses can preferably also evaluate the measured values themselves.

Part of the invention is also the application of one or several suitable switching means respectively, for the flock transportation device and flock processing installation. Such switching means are actually of known art. New and inventive is their application within a device or installation respectively according to the invention. The actual switching means can for instance be a device which releases one or several gas impulses in order to deviate the corresponding fibre material (for instance onto another transportation path). Such devices are described in the already mentioned disclosures, in particular in EP-A-43 40 173 and EP-A-824 607. A further type of applicable switching means is described in U.S. Pat. No. 4,171,262. There the device consists of a pneumatically movable flap and a control unit pertaining to it. Of course, the switching means applicable to the invention does not need to be limited to said two types of devices.

The invention may furthermore include the idea that one or several monitoring apparatuses for the application in flock transportation devices and flock processing installations according to the above description, are to be applied in combination with at least one switching means.

The invention may also include the idea to couple the monitoring apparatuses with further measuring apparatuses, such as a separating device for foreign fibres so that these can interact with one another.

An important type of embodiment of the invention is that the flock processing installation for textile processing machines comprises a preferably central, control means to control the flock quantity and flock varieties supplied by the feeding means. Whereat the switching apparatuses as well as the switching means of the flock processing installation are additionally connected to the control means and that the control means can also control or determine respectively, the transportation paths, in dependence of the variety actually delivered by the feeding means (for instance the bale opener A11), and/or the supplied fibre quantity and/or the desired end composition of the product (or the end product respectively, of the line, such as sliver, lap, fibre web etc.). The control means thereby be set in such a way (or programmed) that it itself determines the optimal or necessary transportation paths for the flocks in dependence of the mentioned factors. It is possible that individual switching means within the sub-sections of the transportation paths are not connected to the control unit. It is also clear that the control means cannot control the transportation paths arbitrarily, but it is bound to certain frame conditions (most of all, on the condition that an optimal cleaning should be achieved or that for instance certain transportation paths are defined for other varieties and therefore cannot be selected).

The embodiment according to the inventions described in the last paragraph also includes the corresponding flock processing method for textile processing machines. That is, a method is provided wherein the transportation paths can also be selected or determined respectively, in dependence of the variety delivered momentarily by the feeding means (for instance bale opener) and/or fibre quantity and/or in dependence of the desired end composition of the product (or the end product respectively of the line, such as sliver, lap, fibre web etc.).

The invention includes the application of one or several of the following treatment stages within the flock processing installations according to the invention: the coarse cleaning, the fine cleaning, the intensive cleaning, the intensive opening or the mixing or a combination of the mentioned process types.

The monitoring apparatus preferably comprises optical sensors, for instance a CCD-camera or CCD-sensors respectively. The monitoring apparatus can detect the following characteristics of the fibre material:

the number of the debris particles contained:

The signals transmitted by the sensors can be counted during an evaluation and preferably can also be examined with respect to size or frequency of the different sizes. For each chosen criteria at least one threshold value can be determined so that when exceeding the threshold value, switching is initiated.

number of fibre knottings/nep flaws contained:

Again, the frequency can be examined or the frequency as a switching criteria in the control unit respectively, can be defined.

actual flock size shade of the material

In a further type of embodiment of the invention, it is also possible, as already mentioned, that the results from the monitoring apparatuses about the condition of the momentarily transported fibre flocks not only serve for the switching of the optimal transportation path, but that this evaluation can also serve for the setting of certain operating parameters of the succeeding treatment stage. For this, the preceding monitoring apparatus not only interacts with the succeeding treatment stage but also, via a central control means which registers the evaluations of the monitoring apparatus, determines and forwards said parameters to the succeeding treatment stage.

The treatment characteristics of the different transportation paths preferably differentiate themselves from each other with regard to intensity (for instance aggressiveness) during fibre treatment. Thereby, for instance different cleaning effects or different opening effects respectively are generated. A relatively dirty, or with frequent neps, or badly opened material is therefore detoured onto a transportation path which is provided with machines and apparatuses which achieve a relatively high cleaning and opening effect (however, with a relative high strain on the fibre, for instance staple shortening). A relatively clean material is led onto a transportation path with a relatively fibre friendly treatment characteristic (possible without a cleaning machine), whereat it is accepted that the existing degree of contamination is hardly reduced.

BRIEF DESCRIPTION OF THE FIGURES

Exemplified embodiments of the invention are now described by way of the figures of the drawing, wherein show schematically.

DETAILED DESCRIPTION

Figure 1:
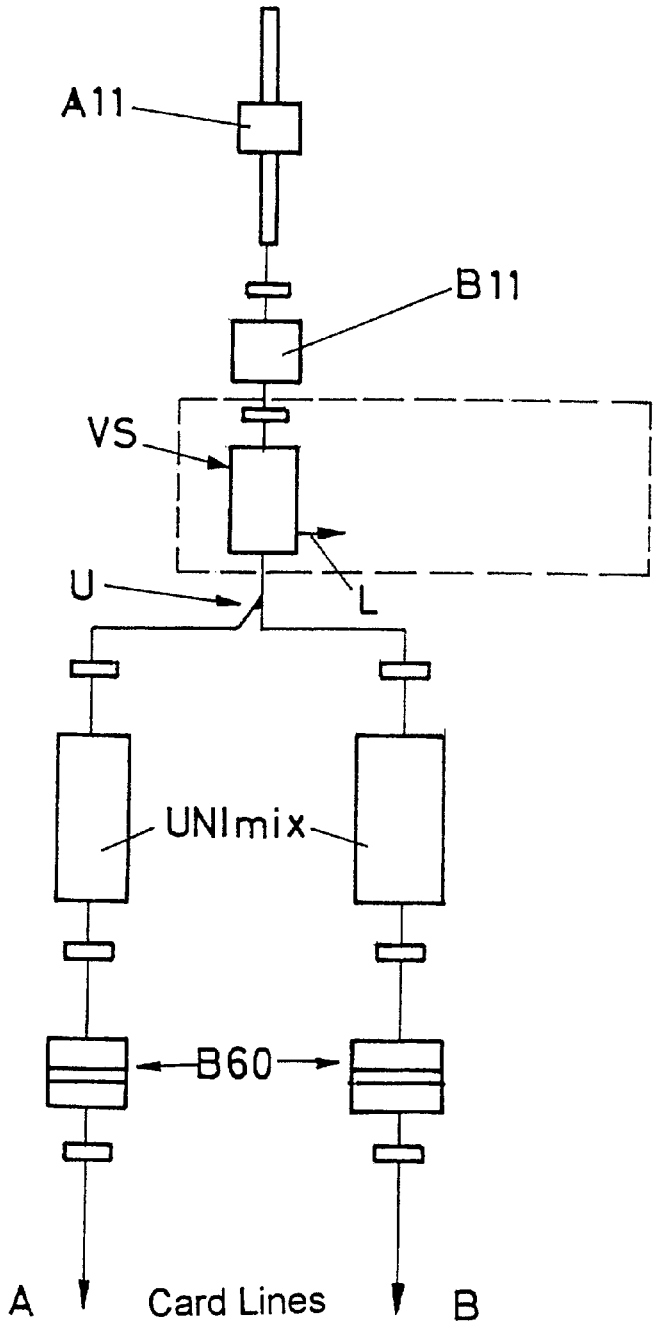
FIG. 1 an outline of a conventional blowing room for comparison.

Reference will now be made in detail to embodiments of the invention, one or more of which are shown in the drawings. Such embodiments are provided by way of explanation of the invention, and not as a limitation of the invention. It should be apparent that modifications and variations can be made to the described embodiments without departing from the scope and spirit of the invention.

The examples are described by way of the cleaning machines available from the present assignee Rieter, and wherever possible, the corresponding model types are used as references in the figures. The invention is however, in no way limited to the application of said machine types. There are a number of alternative arrangements for a blowing room line according to the invention.

The blowing room line according to FIG. 1 comprises a bale opener A11, a coarse cleaner B11, optionally a foreign particle monitoring or separating apparatus VS, two "UNI-mix" mixers, and two fine cleaners B60, which also serve as card feeding machines. The succeeding cards can be of the conventional type, however, but they are not shown. The bale opener A11 is suitable to supply fibre material in the form of flocks with an output rate of approximately 1200 kg/h (per hour). Thereafter the flock stream is forwarded between the machines of the line in a pneumatic transportation system (indicated schematically by connecting lines), whereat the whole (not separated) stream can flow through the coarse cleaner B11 and the monitoring apparatus VS. The further machines of the line are only able to process a flock flow with a throughput rate of maximum 600 kg/h. After the monitoring apparatus VS, the flock stream is divided into two sub-streams (each is divided into a sub-line A or B respectively). This takes place by means of a switching device U. The monitoring apparatus itself does not play a role in this connection. The apparatus can for example be designed according to EP-A-824 607 and serves to separate foreign material from the flock stream for instance by way of branching L. The treatment characteristic of the two sub-lines A or B, can be the same (only one variety) or different (multi-variety operation). The control of the apparatus U takes place either in dependence of the filling level of the storage within the sub-line A or B, (only one variety) or in dependence of the switching signals from the bale opener A11 (multi-variety operation).

Figure 2:
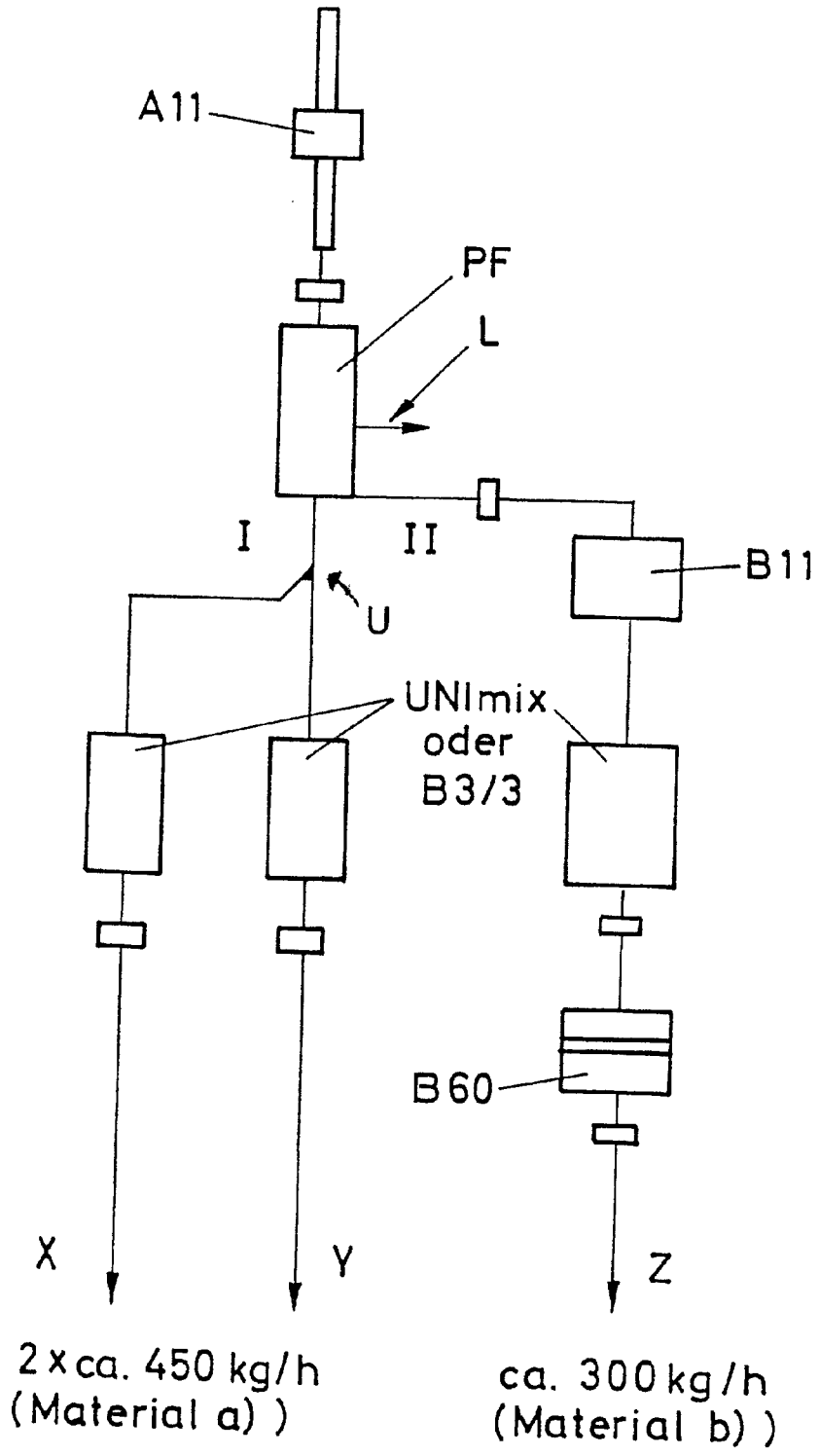
FIG. 2 an outline of a first embodiment of a blowing room line according to the invention, FIG. 3 an outline of a second embodiment of a blowing room line according to the invention, FIG. 4 a cross section through a monitoring apparatus with a switching means according to the invention, FIG. 5 a by-pass unit, and FIG. 6 an example of a possible flock processing installation with different flock transportation device and several transportation paths.

The blowing room line according to FIG. 2 comprises basically the same opening, cleaning and mixer machine types, which are not described again individually. The arrangement of these machines, however, is now different and the monitoring apparatus PF differs from the apparatus VS according to FIG. 1, as will be explained hereafter. The flock stream being supplied by the bale opener A11 is now led directly to the apparatus PF and the transportation system following the apparatus PF is divided into three sub-lines X, Y, Z. the two partial lines X and Y branch off from a switching unit U (compare with FIG. 1) and for fibre processing they only comprise one mixing machine UNI-mix. The third sub-line Z comprises a coarse cleaner B11, mixing machine UNImix, and a fine cleaner B60. This sub-line already branches off from the monitoring apparatus PF, i.e. the latter apparatus in this variant comprises a controllable switching device (see FIG. 4 later on), which switches the material flowing through between an outlet I and an outlet II. Outlet I leads to the switching apparatus U while outlet II leads to the sub-line Z.

The apparatus PF determines, by means of its sensors, (with a corresponding signal evaluation) whether the material delivered from the bale opener fulfills the predetermined criteria. Examples of such criteria where mentioned in the introduction of the description. These can be applied in the control unit either individually or in combination, in order to initiate the switching between the outlets I and II. Relatively dirty or with frequent neps material is led to outlet II (into the sub-line Z) while pure material is led through to the outlet I. The sub-lines can be designed in such a way that the two lines X and Y each for instance have a through put rate or output rate respectively of 450 kg/h, the partial line Z however, only a through put rate output rate respectively, of approximately 300 kg/h. the product of the sub-line X or Y respectively, can be engaged for the production of yarns or higher quality, the products of the sub-line Z for the production of yarns of lower quality.

Figure 3:
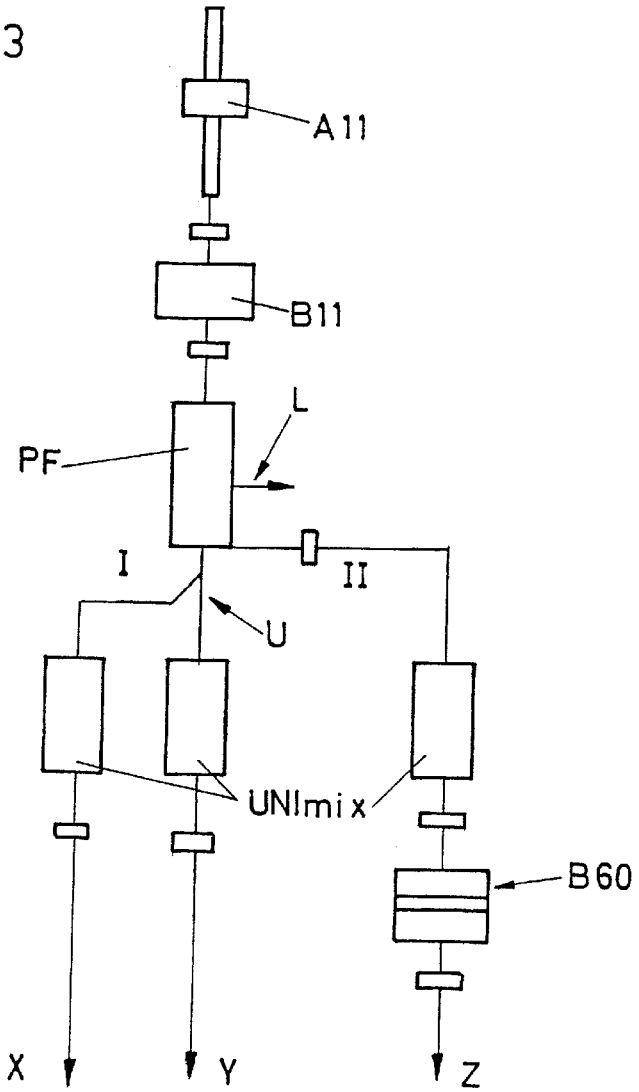

The variant according to FIG. 3 will be understood without any further description—it corresponds with the variant according to FIG. 2, with the exception that the coarse cleaner B11 again has been put in front of the monitoring apparatus PF (see FIG. 1). The whole output of the bale opener A11 thus undergoes a coarse cleaning step at a relatively low working intensity, whereat only the dirty portion undergoes an intensive fine cleaning.

Figure 4:
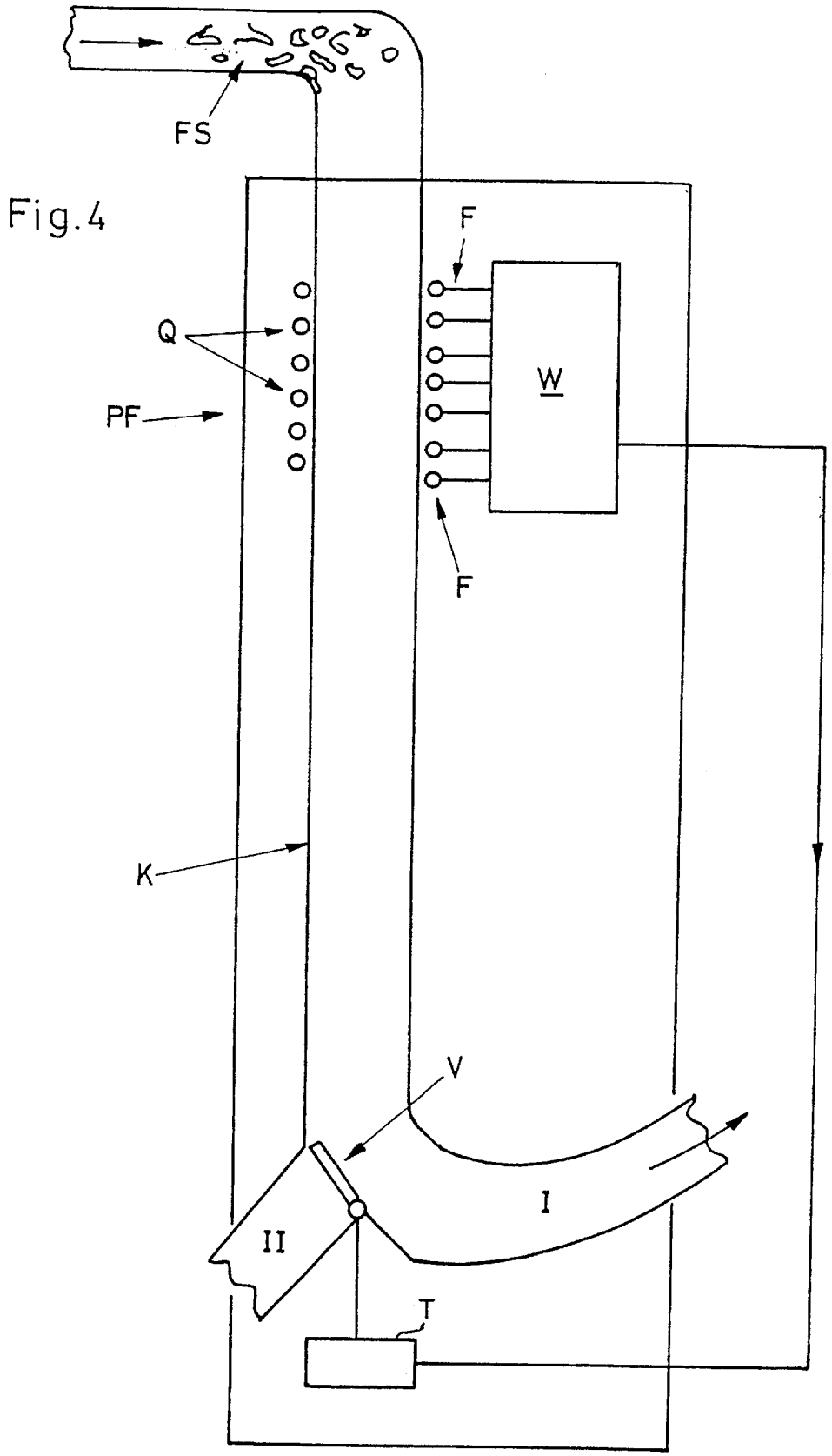

The monitoring apparatus PF according to FIG. 4 comprises a through low channel K for the flock stream (indicated schematically with FS), the two outlets I and II and a controllable switching flap V. Light sources Q are on one side of the channel K and photo sensors F are on the opposite side. The channel walls are here transparent. The signals of the sensors F are transmitted to an evaluation means W, where they are evaluated according to the previously mentioned criteria. Depending on the results of these evaluations, the flap V is either switched by means of a suitable actuator device T for either to open outlet I or the outlet II. Instead of the shown switching flap V, also other elements/designs can be applied as switching means for the fibre flocks, for instance pneumatic type discharger or suction type extractors. This may generally take place, i.e. simultaneously throughout the entire working width, as well as selectively only at a specific point over the working width, where contaminated flocks have been detected by the monitoring apparatus PF. Such switching means are for instance already known from U.S. Pat. No. 4,171,262, DE-A-43 40 173, DE-A-197 22 537, Ep-A-396,546 or EP-A-824 607.

The invention is not limited to the illustrated examples. These variants can for instance be further developed according to the principles listed in EPA-810 309, whereat a fine cleaning is transferred into the card. Such a further development could for instance be used to supplement the cleaning effect in a sub-line X and/or Y or for the application of the fine cleaner B60 within the sub-line Z.

Figure 5:
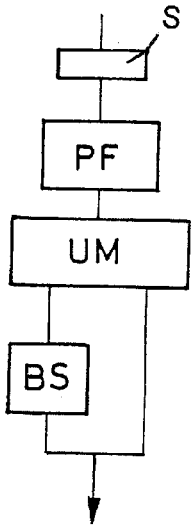

FIG. 5 shows a by-pass unit. As can be seen from the illustration, a storage device S can be provided at the inlet of the unit. The flock supply then passes a monitoring apparatus PF. For simplicity reasons in this document a monitoring apparatus is often mentioned. This, however, does not exclude that a "monitoring apparatus" may comprise several such apparatuses or sensors respectively, so that several flock characteristics can be measured simultaneously. From the technical point of view, the monitoring apparatus is succeeded by a switching means UM. As is indicated in FIG. 4, the switching means can also be contained within the same casing. In the illustration, the switching means possesses two outlets. At the first outlet there is the throughput without fibre treatment. The second outlet leads to a treatment stage BS. It is also feasible to have by-pass units with more than two outlets from the switching apparatus and several treatment stages. At the end of the by-pass unit the sub-section with the different treatment stages again merge and thus form one outlet from the by-pass unit.

Figure 6:
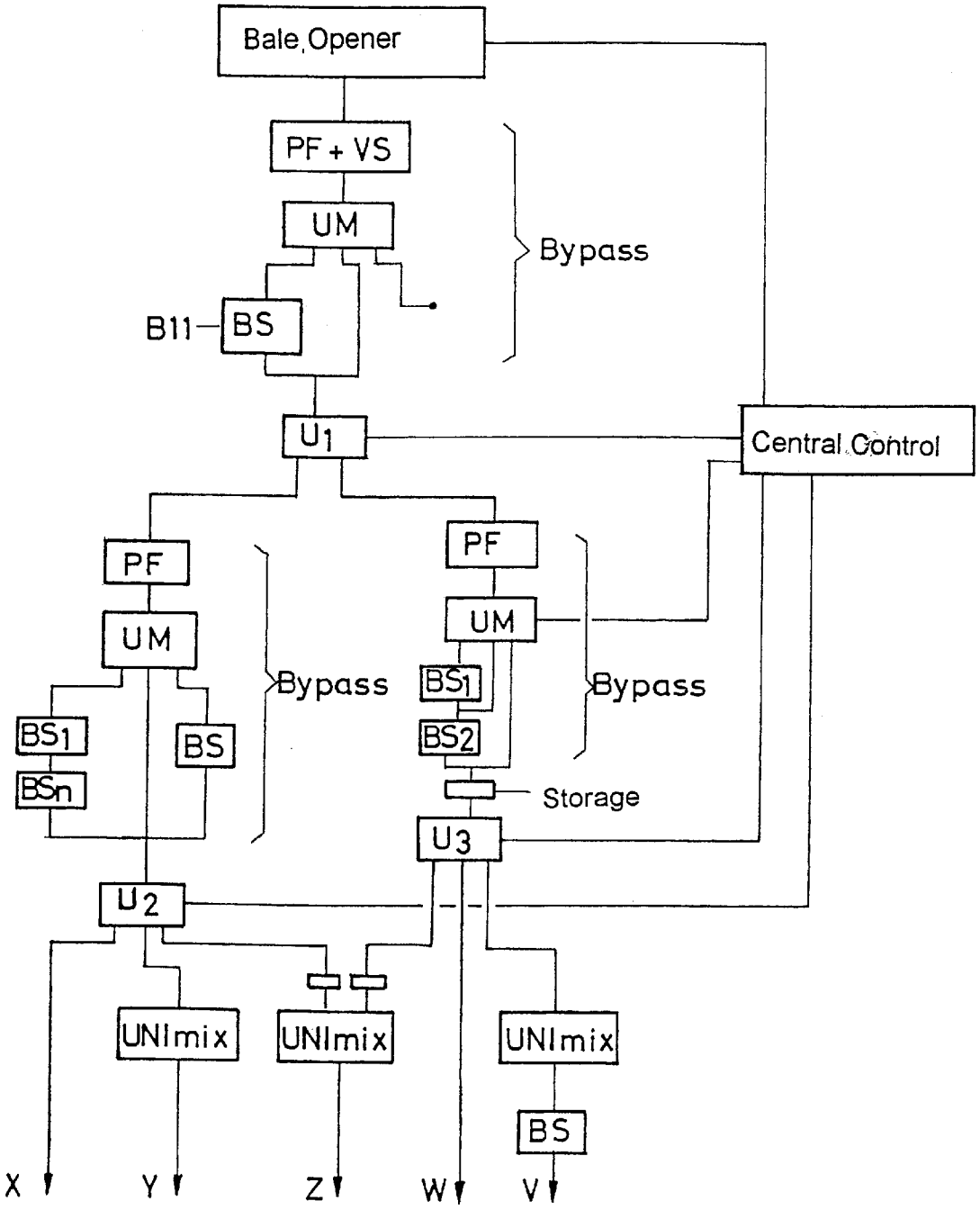

FIG. 6 shows an example of a flock processing installation. It comprises a combination of different flock transport devices and several transportation paths which lead to different products. The bale opener, which can have a bale input with different varieties in this example is for instance connected to a central control means. Said control means can interact with the bale opener. Thus the control means, depending on the actual worked off variety, can control the transportation paths within certain limits. The pneumatic transportation system leads the flock stream from the bale opener to the first by-pass unit. The monitoring apparatus PF thereby interacts with a further detector VS (for instance a metal detector). The succeeding switching means UM is thereby also able to discharge foreign matter. The treatment stage BS of this unit can for instance comprise a coarse cleaner such as the B11 of Rieter. This flock transport device is followed by a switching apparatus U, which is solely controlled by the central control means (usually in dependence of the actual worked-off variety). The switching apparatus $U_1$ divides the transportation system into two sub-streams, each of which may have a respective monitoring apparatus PF, switching means UM, and treatment stages BS $BS_1, \ldots B_n$. Within the left sub-stream a further by-pass follows with three different sub-sections and a further switching apparatus $U_2$, which is also controlled by the central control means. Depending on the position of $U_2$, one obtains the end products X, Y, Z. It is to be mentioned that each of these end products can pass through different transportation paths. Furthermore, these transportation paths are not completely controllable by the control means, since not all switching means UM can be controlled. In the right sub-stream after the switching apparatus $U_1$, a further by-pass follows with another flock stream routing within the same by-pass unit. The switching means UM thereby is being connected with the control means. The outlet of the bypass leads the flock stream to a storage. The succeeding switching device $U_3$ which follows (also connected with the control means) has three outlets which lead to three end products Z, W, V whereat one product is being mixed with the fibre stream of the left sub-stream. The single outlets of $U_2$ and $U_1$ are followed by further treatment stages, such as the mixing in the unimix machines. Not further shown is the succeeding treatment of the fibres in such an installation (for instance carding).

The invention, however is in no way limited to the explicitly mentioned types of embodiments and examples. These types of embodiments are to be understood as ideas for a person skilled in the art. On the basis of the types of embodiments it will be easy to derive preferred combinations and applications which are also included within the scope of the object of this invention and which are to be protected by way of this application.

What is claimed is:

1. A fiber flock material transport system for textile processing machines, comprising:

a plurality of separate transportation paths, and at least one switching mechanism disposed to direct fiber flock transported by said system between different ones of said transportation paths, said transportation paths having different treatment characteristics for cleaning fiber material of different degrees of contamination;

at least one evaluation apparatus disposed operably in said system upstream of said switching mechanism with respect to a direction of flow of fiber flock material through said system, said evaluation apparatus in communication with said switching mechanism; and wherein said evaluation apparatus is configured to detect and measure a degree of contamination of the transported fiber flock material and control said switching mechanism as a function of said contamination to direct the fiber flock material to different ones of said transportation paths depending on its respective degree of contamination for cleaning in said transportation path.

2. The system as in claim 1, comprising a supply source of fiber flock material and at least one by-pass unit downstream of said supply source, said by-pass unit including at least one said evaluation apparatus and associated switching mechanism, said by-pass unit including a flock supply branch preceding said evaluation apparatus and at least two separate transportation paths downstream of said switching mechanism.

3. The system as in claim 2, further comprising a plurality of said by-pass units.

4. The system as in claim 3, wherein said by-pass units are arranged in serial in said transport system.

5. The system as in claim 3, wherein said by-pass units are arranged in parallel in said transport system.

6. The system as in claim 3, wherein at least two said by-pass units are arranged in serial and at least two said by-pass units are arranged in parallel in said transport system.

7. The system as in claim 2, wherein said by-pass unit transportation paths merge into a single outlet path downstream of said switching mechanism.

8. The system as in claim 2, wherein at least one of said transportation paths downstream of said switching apparatus comprises a fiber flock material treatment stage and at least one other said transportation path downstream of said switching apparatus is without a treatment stage, said evaluation apparatus actuating said switching mechanism to divert the fiber flock material between said transportation paths as a function of the necessity of treating the fiber flock material.

9. The system as in claim 8, wherein said transportation path without said treatment stage and said transportation path with said treatment stage merge into a single transportation path.

10. A fiber flock material transport system for textile processing machines, comprising:

a common flock material supply;

a plurality of separate transportation paths in communication with said supply, at least one said transportation paths further comprising a treatment stage that is different from a treatment stage of another said transportation path;

at least one switching mechanism disposed to direct fiber flock material transported by said system between different ones of said transportation paths; and at least one evaluation apparatus disposed operably in communication with and upstream of said switching mechanism with respect to a direction of flow of fiber flock material through said system to detect and measure a degree of contamination of the transported fiber flock material and control said switching mechanism as a function of said contamination to direct the fiber flock material to different ones of said transportation paths for treatment by said treatment stages depending on its respective degree of contamination.

11. The system as in claim 10, wherein a plurality of said transportation paths comprise at least one by-pass unit, said by-pass unit comprising at least one said evaluation apparatus and associated switching mechanism.

12. The system as in claim 11, wherein each said bypass unit further comprises at least one treatment stage.

13. The system as in claim 12, wherein said treatment stages are in communication with said evaluation apparatus for at least partially setting operational parameters of said treatment stages as a function of contamination of the fiber flock material.

14. The system as in claim 10, further comprising a central control system in communication with said switching mechanism and said evaluation unit, said central control system configured to also control said switching mechanism as a function of any combination of fiber flock variety, fiber quantity, and fiber composition of an end product produced by the textile processing machines.

15. The system as in claim 10, wherein at least one of said transportation paths downstream of said switching apparatus comprises a fiber flock material treatment stage including any combination of a coarse cleaner, a fine cleaner, and intensive cleaner, an opener, and a mixer.

* * * * *